US010078295B2

(12) United States Patent
Kogure et al.

(10) Patent No.: US 10,078,295 B2
(45) Date of Patent: Sep. 18, 2018

(54) BELT DEVICE AND IMAGE FORMING APPARATUS INCORPORATING SAME

(71) Applicants: Seiichi Kogure, Kanagawa (JP); Junpei Fujita, Kanagawa (JP)

(72) Inventors: Seiichi Kogure, Kanagawa (JP); Junpei Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/829,044

(22) Filed: Dec. 1, 2017

(65) Prior Publication Data

US 2018/0157196 A1 Jun. 7, 2018

(30) Foreign Application Priority Data

Dec. 5, 2016 (JP) ..... 2016-236202

(51) Int. Cl.
*G03G 15/16* (2006.01)
*G03G 15/01* (2006.01)

(52) U.S. Cl.
CPC ..... *G03G 15/1615* (2013.01); *G03G 15/0131* (2013.01); *G03G 15/161* (2013.01)

(58) Field of Classification Search
CPC ..... G03G 15/1615; G03G 15/0132; G03G 15/161
USPC ..... 399/101
See application file for complete search history.

(56) References Cited

U.S. PATENT DOCUMENTS 4,033,694 A * 7/1977 Ferrari ..... G03B 27/6264 271/195
4,983,146 A * 1/1991 Charles ..... B82Y 15/00 399/288
5,983,062 A * 11/1999 Sameshima ..... G03G 15/1605 399/110
7,421,239 B2 * 9/2008 Kimura ..... G03G 15/161 399/123
9,164,433 B2 * 10/2015 Kudo ..... G03G 15/161
2010/0247174 A1 * 9/2010 Hori ..... G03G 15/167 399/303
2011/0064487 A1 3/2011 Ichihashi et al.
2011/0158690 A1 6/2011 Mimbu et al.
2011/0274474 A1 11/2011 Arai et al.
(Continued)

FOREIGN PATENT DOCUMENTS

JP 2007-047702 A 2/2007
JP 2011-039472 A 2/2011
JP 2014-016390 1/2014

OTHER PUBLICATIONS

Extended European Search Report dated Mar. 6, 2018 issued in corresponding European Application No. 17205143.5.

*Primary Examiner* — Susan Lee
(74) *Attorney, Agent, or Firm* — Harness, Dickey & Pierce, P.L.C.

(57) ABSTRACT

A belt device includes an endless belt, a support shaft, a contact member, and a regulating member. The support shaft supports the contact member. The contact member rotates together with the support shaft and contacts the belt. The regulating member moves between a regulating position to regulate movement of the support shaft and a releasing position to allow movement of the support shaft, thereby regulating movement of the contact member in an axial direction of the support shaft.

14 Claims, 14 Drawing Sheets

(56) References Cited

U.S. PATENT DOCUMENTS

| | | | | |
|---|---|---|---|---|
| 2012/0045245 | A1* | 2/2012 | Sakurai | G03G 15/1615 399/121 |
| 2013/0016989 | A1 | 1/2013 | Fujita et al. | |
| 2013/0216260 | A1 | 8/2013 | Kogure et al. | |
| 2014/0010572 | A1 | 1/2014 | Karasawa et al. | |
| 2015/0055981 | A1 | 2/2015 | Fujita et al. | |
| 2015/0378284 | A1 | 12/2015 | Wada et al. | |
| 2016/0041508 | A1 | 2/2016 | Kogure et al. | |
| 2016/0161888 | A1 | 6/2016 | Wada et al. | |
| 2016/0170363 | A1 | 6/2016 | Kogure et al. | |
| 2016/0170364 | A1 | 6/2016 | Kogure et al. | |
| 2016/0274504 | A1 | 9/2016 | Wada et al. | |
| 2017/0090374 | A1 | 3/2017 | Fujita et al. | |
| 2017/0235257 | A1 | 8/2017 | Kochi et al. | |
| 2017/0235258 | A1 | 8/2017 | Wada et al. | |

* cited by examiner

BELT DEVICE AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2016-236202, filed on Dec. 5, 2016, in the Japan Patent Office, the entire disclosure of which is hereby incorporated by reference herein.

BACKGROUND

Technical Field

This disclosure generally relates to a belt device and an image forming apparatus that incorporates the belt device, such as a copier, a printer, a facsimile machine, or a multifunction peripheral having at least two of copying, printing, facsimile transmission, plotting, and scanning capabilities.

Related Art

Image forming apparatuses using an electrophotographic process to form images include a belt device to transfer a toner image. The belt device includes a belt stretched around a plurality of support rotators. A cleaning device to clean the belt and a lubricant applicator to apply lubricant to the belt are positioned to contact or press against the belt.

SUMMARY

According to an embodiment of this disclosure, an improved belt device includes an endless belt, a support shaft, a contact member, and a regulating member. The support shaft supports the contact member. The contact member rotates together with the support shaft and contacts the belt. The regulating member moves between a regulating position to regulate movement of the support shaft and a releasing position to allow movement of the support shaft, thereby regulating movement of the contact member in an axial direction of the support shaft.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
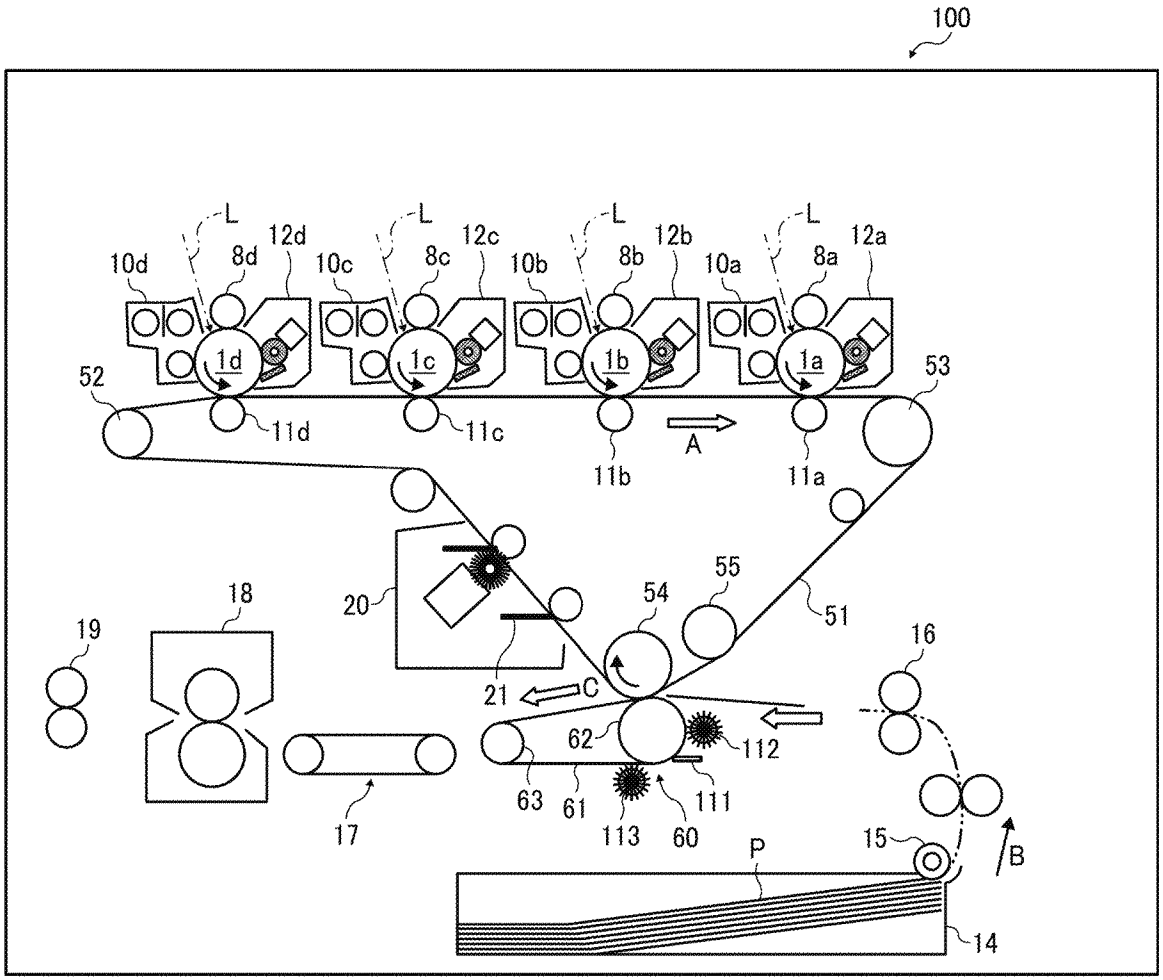
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, an image forming apparatus according to an embodiment of the present disclosure is described below. In the description of embodiments below, components having the same function and configuration are appended with the same reference codes, and redundant descriptions thereof may be omitted. Components in the drawings may be partially omitted to facilitate understanding of the configurations. As used herein, the singular forms "a", "an", and "the" are intended to include the plural forms as well, unless the context clearly indicates otherwise.

In the drawings, like reference numerals designate identical or corresponding parts throughout the several views thereof.

FIG. 1 is a schematic view illustrating a printer 100 as an image forming apparatus according to the present embodiment. In the printer 100, a toner image is formed on a circumferential surface of an intermediate transfer belt 51 (intermediate transferor) as an image bearer and transferred onto a recording sheet P (recording medium) by a belt device 60 as a transfer device. The printer 100 includes four drum-shaped photoconductors 1*a*, 1*b*, 1*c*, and 1*d* as image bearers disposed inside a main body of the printer 100. Toner images of different colors are formed on circumferential surfaces of the photoconductors 1*a*, 1*b*, 1*c*, and 1*d*, respectively. More specifically, black toner images, magenta toner images, cyan toner images, and yellow toner images are formed on the circumferential surfaces of the photoconductors 1*a*, 1*b*, 1*c*, and 1*d*, respectively. In the present embodiment, the photoconductors 1*a*, 1*b*, 1*c*, and 1*d* are drum-shaped. Alternatively, the printer 100 can employ, as photoconductors, endless belts entrained around a plurality of rollers and driven to rotate.

The intermediate transfer belt 51 is an endless belt as the image bearer disposed facing the photoconductors 1*a*, 1*b*, 1*c*, and 1*d*. The circumferential surface of each of the photoconductors 1*a*, 1*b*, 1*c*, and 1*d* contacts the circumferential surface of the intermediate transfer belt 51. In the present embodiment, the intermediate transfer belt 51 is entrained about and stretched taut around a plurality of support rollers: a tension roller 52, a driving roller 53, a repulsive roller 54, an entry roller 55, and the like. As a drive source drives the driving roller 53, which is one of the support rollers, the intermediate transfer belt 51 rotates in a direction indicated by arrow A in FIG. 1.

The intermediate transfer belt 51 is either a single-layer belt or a multi-layer belt. In the case of the multi-layered belt, a base layer of the belt is for example formed of a relatively inelastic fluorine resin, a polyvinylidene fluoride (PVDF) sheet, and polyimide resin, with a smooth coating layer of fluorine resin deposited on the circumferential surface of the intermediate transfer belt 51. In the case of the single-layer belt, the belt can be made of, selected from, for example, polyvinylidene fluoride (PVDF), polycarbonate (PC), polyimide (PI), or the like.

Regardless of the color of toner, the configuration and operation to form toner images on the photoconductors 1*a*, 1*b*, 1*c*, and 1*d* are the same. Similarly, the configuration and operation to primarily transfer the toner images onto the intermediate transfer belt 51 are the same regardless of the color of toner. Accordingly, a description is given of the configuration and operation to form black toner images on the photoconductor 1*a* and primarily transfer black toner images onto the intermediate transfer belt 51, with a description of the configuration and operation of other colors omitted to avoid redundancy.

The black photoconductor 1*a* rotates counterclockwise in FIG. 1. The surface potential of the photoconductor 1*a* is initialized by a discharger, uniformly charged to a predetermined polarity (negative polarity in the present embodiment) by the charging device 8*a*. An exposure device irradiates the charged circumferential surface of the photoconductor 1*a* with a modulated laser beam L, thereby forming an electrostatic latent image on the circumferential surface of the photoconductor 1*a*.

According to the present embodiment, the exposure device is a laser writing device that emits the laser beam L. Alternatively, the exposure device can include a light-emitting diode (LED) array and an imaging device. The electrostatic latent image formed on the photoconductor 1*a* is developed with black toner by a developing device 10*a* into a visible image, known as a black toner image.

Primary transfer rollers 11*a*, 11*b*, 11*c*, and 11*d* are disposed inside the looped intermediate transfer belt 51, facing the photoconductors 1*a*, 1*b*, 1*c*, and 1*d*, respectively. The primary transfer roller 11*a*, hereinafter described as a representative example of the primary transfer rollers, contacts the inner circumferential surface of the intermediate transfer belt 51 to form a primary transfer nip between the photoconductor 1*a* and the intermediate transfer belt 51. A primary transfer voltage opposite to charging polarity of the toner image on the photoconductor 1*a* is applied to the primary transfer roller 11*a*. In the present embodiment, the primary transfer voltage has a plus (positive) polarity. Thus, a primary-transfer electrical field is generated between the photoconductor 1*a* and the intermediate transfer belt 51, and the toner image on the photoconductor 1*a* is electrically and primarily transferred onto the intermediate transfer belt 51 that rotates in synchronization with the photoconductor 1*a*. After the toner image is primarily transferred onto the intermediate transfer belt 51, a cleaning device 12*a* removes residual toner adhering to the circumferential surface of the photoconductor 1*a*.

In full-color image formation (full-color mode) employing toner of four different colors, similar to the black toner image, a magenta toner image, a cyan toner image, and a yellow toner image are formed on the photoconductors 1*b*, 1*c*, and 1*d*, respectively. The yellow, cyan, magenta, and black toner images are primarily transferred and superimposed one atop the other onto the intermediate transfer belt 51. That is, toner images of a plurality of colors are transferred and superimposed onto the intermediate transfer belt 51.

By contrast, in single-color or monochrome image formation (single-color mode) employing black toner, the primary transfer rollers 11*b*, 11*c*, and 11*d*, other than the primary transfer roller 11*a* for black, are separated from the photoconductors 1*b*, 1*c*, and 1*d* for the colors magenta, cyan, and yellow by a contact-separation mechanism. Thus, the photoconductors 1*b*, 1*c*, and 1*d* are separate from the intermediate transfer belt 51. In a state in which only the photoconductor 1*a* is in contact with the intermediate transfer belt 51, the black toner image is primarily transferred onto the intermediate transfer belt 51.

As illustrated in FIG. 1, a sheet feeding device 14 is disposed substantially at the bottom of the main body of the printer 100. The sheet feeding device 14 includes a feed roller 15 to pick up and send the recording sheet P in a direction indicated by arrow B in FIG. 1. The recording sheet P fed by the feed roller 15 is delivered to a secondary transfer nip by a pair of registration rollers 16 in a predetermined timing. The intermediate transfer belt 51 entrained about the repulsive roller 54 contacts a secondary transfer belt 61 of a belt device 60 to form the secondary transfer nip. At that time, a secondary-transfer power source as a transfer voltage output device applies a predetermined secondary transfer voltage to the repulsive roller 54 to secondarily transfer the toner image from the intermediate transfer belt 51 onto the recording sheet P.

The belt device 60 includes the secondary transfer belt 61 stretched around a secondary transfer roller 62 and a separation roller 63. The secondary transfer belt 61 transports the recording sheet P. One of the secondary transfer roller 62 and the separation roller 63 (support rollers) is a driving roller, and rotation thereof enables the secondary transfer belt 61 to rotate in a direction indicated by arrow C in FIG. 1. The recording sheet P, onto which the toner image is secondarily transferred, is transported on the circumferential surface of the secondary transfer belt 61 while being attracted electrostatically to the circumferential surface of the secondary transfer belt 61. Subsequently, the recording sheet P separates from the surface of the secondary transfer belt 61 due to curvature of a portion of the secondary transfer belt 61 looped around the separation roller 63. Then, the recording sheet P is transported further downstream from the secondary transfer belt 61 in a direction of conveyance of the recording sheet P by a conveyance belt 17 disposed downstream from the secondary transfer belt 61. When the recording sheet P passes through a fixing device 18 which applies heat and pressure to the toner image on the recording sheet P, the toner image is fixed to the recording sheet P. After the recording sheet P passes through the fixing device 18, the recording sheet P is discharged outside the main body through a pair of output rollers 19 of a discharge unit.

Residual toner and paper dust adhere to the intermediate transfer belt 51 after the toner image is secondarily transferred. Therefore, the intermediate transfer belt 51 is provided with a belt cleaning device 20 that removes the residual toner and the paper dust. In the present embodiment, the belt cleaning device 20 includes a cleaning blade 21 made of urethane or the like. The cleaning blade 21 contacts the intermediate transfer belt 51 against a direction of travel of the intermediate transfer belt 51. The belt cleaning device 20 is not limited to the structure described above but can be selected from various cleaning types. For example, a cleaning device to electrostatically clean the intermediate transfer belt 51 can be used.

In addition to the function of conveying the recording sheet P, a test toner pattern for controlling a toner density is transferred to the secondary transfer belt 61. The test toner patterns are formed on the photoconductors 1*a*, 1*b*, 1*c*, and 1*d* of the respective colors by the above-described electrophotographic process, transferred to the intermediate transfer belt 51 at the primary transfer nip, and then transferred to the secondary transfer belt 61 at the secondary transfer nip. The transferred test toner pattern can be detected by a sensor. The test toner pattern detected by the sensor is removed by the belt cleaning device 110 for the secondary transfer belt 61.

In the present embodiment, the belt device 60 includes a belt-deviation restriction mechanism. A shaft inclining device 70 as the belt-deviation restriction mechanism inclines a rotary shaft 63*a* of the separation roller 63 to restrict deviation of the secondary transfer belt 61 (hereinafter, also referred to as "belt deviation) within a predetermined permissible range. The separation roller 63 is one of support rollers around which the secondary transfer belt 61 stretches. The shaft inclining device 70 displaces an end portion of the rotary shaft 63*a* in a predetermined direction to incline the rotary shaft 63*a*. The predetermined direction is a direction to correct the belt deviation. In the present embodiment, the predetermined direction is downward.

Figure 3:
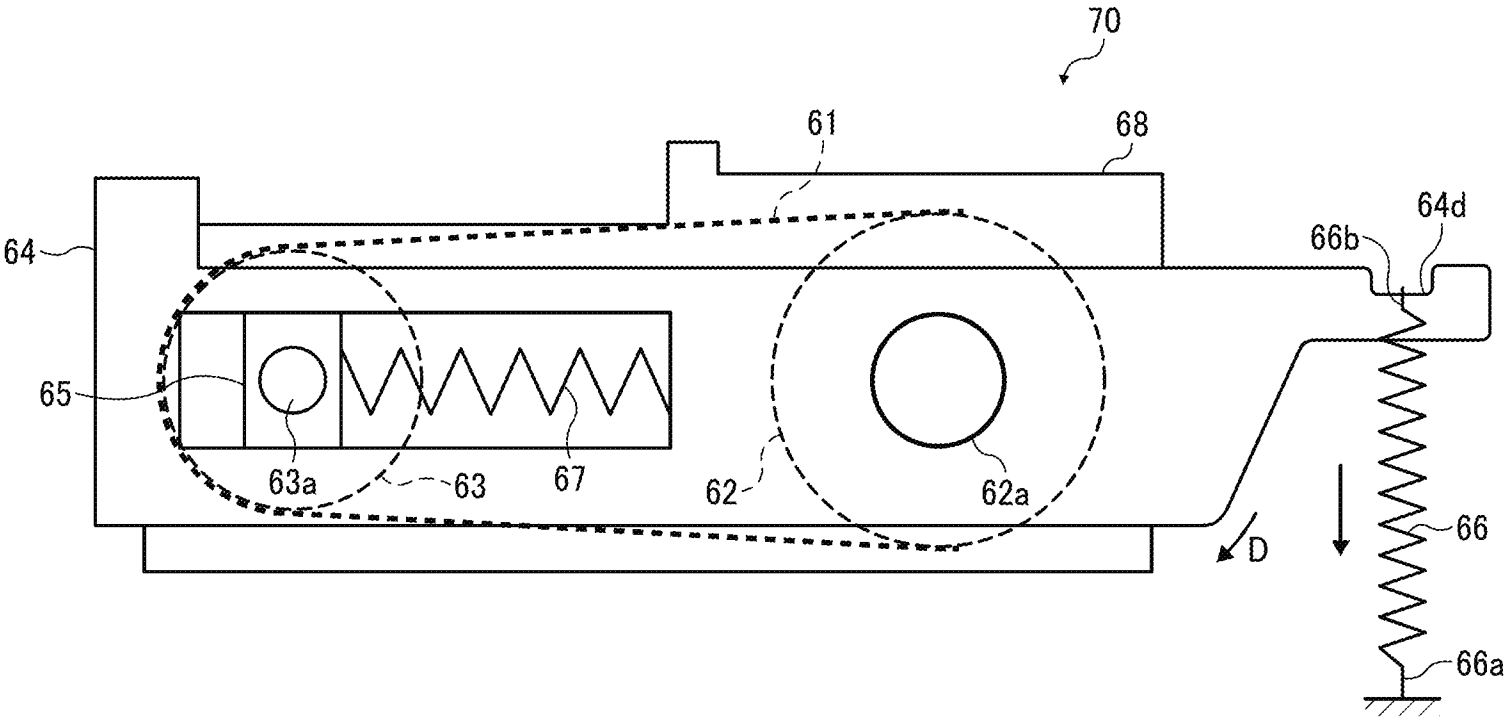
FIG. 3 is a schematic view illustrating a shaft inclining device of the belt device in FIG. 2 immediately after assembly as viewed from an end of a rotary shaft of a separation roller in an axial direction.
Figure 4:
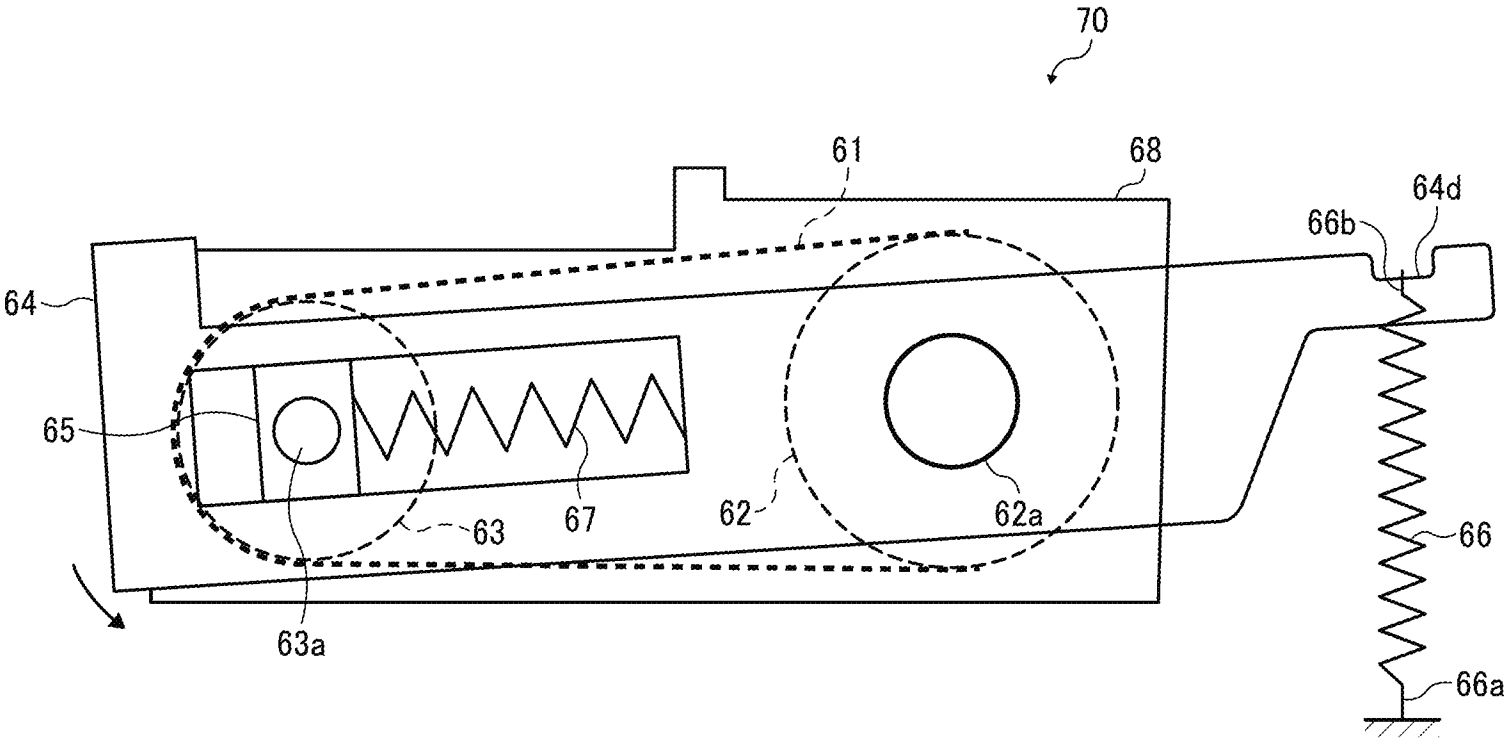
FIG. 4 is a schematic view illustrating the shaft inclining device after correction of deviation of a secondary transfer belt as viewed from the end of the rotary shaft of the separation roller in the axial direction.

FIG. 3 is a schematic view illustrating the shaft inclining device 70 immediately after assembly, as viewed from an end of the rotary shaft 63*a* the separation roller 63 in the axial direction. FIG. 4 is a schematic view illustrating the shaft inclining device 70 after correction of deviation of the secondary transfer belt 61, as viewed from the end of the rotary shaft 63*a* the separation roller 63 in the axial direction.

In the present embodiment, the separation roller 63 is rotatable together with a rotary shaft 63*a* and supports the secondary transfer belt 61. Each end of the rotary shaft 63*a* of the separation roller 63 is supported individually by different shaft support arms 64 as separate supporting members which are parts of the belt-deviation restriction mechanism. Each shaft support arm 64 is rotatably attached to each end of a rotary shaft 62*a* of the secondary transfer roller 62 and is urged in a clockwise direction indicated by arrow D in FIG. 3 by an arm spring 66. One end of one of the arm springs 66 illustrated in FIG. 3 is secured to a regulating member 130 to be described later. One end of the other arm spring 66 is secured to a frame 68, which is disposed near opposite end of the rotary shaft 62*a*, of the belt device 60. In a state in which there is no deviation of the secondary transfer belt 61 immediately after assembly, a rotation position of the shaft support arms 64 is maintained at a position at which shaft inclining members 72, which are to be described detail later, contact the frames 68 due to an urging force of the arm spring 66 as illustrated in FIG. 3. The arm spring 66 urges the rotary shaft 63*a* to be displaced in a direction (upward in the present embodiment) opposite to the predetermined direction. The shaft support arm 64 supports the rotary shaft 63*a* so that the rotary shaft 63*a* is displaceable in the predetermined direction and a direction opposite to the predetermined direction.

As illustrated in FIGS. 3 and 4, each shaft support arm 64 slidably supports a shaft bearing 65 that bears the rotary shaft 63*a* of the separation roller 63 such that the shaft bearing 65 is slidable in a radial direction from the center of rotation of the shaft support arm 64. The shaft bearing 65 is urged outward by a compression spring 67 in the radial direction from the center of rotation of the shaft support arms 64. With this configuration, the separation roller 63 is always urged in such a direction that the separation roller 63 separates from the secondary transfer roller 62. Accordingly, a certain tension is applied to the secondary transfer belt 61 looped around the separation roller 63 and the secondary transfer roller 62.

Figure 5:
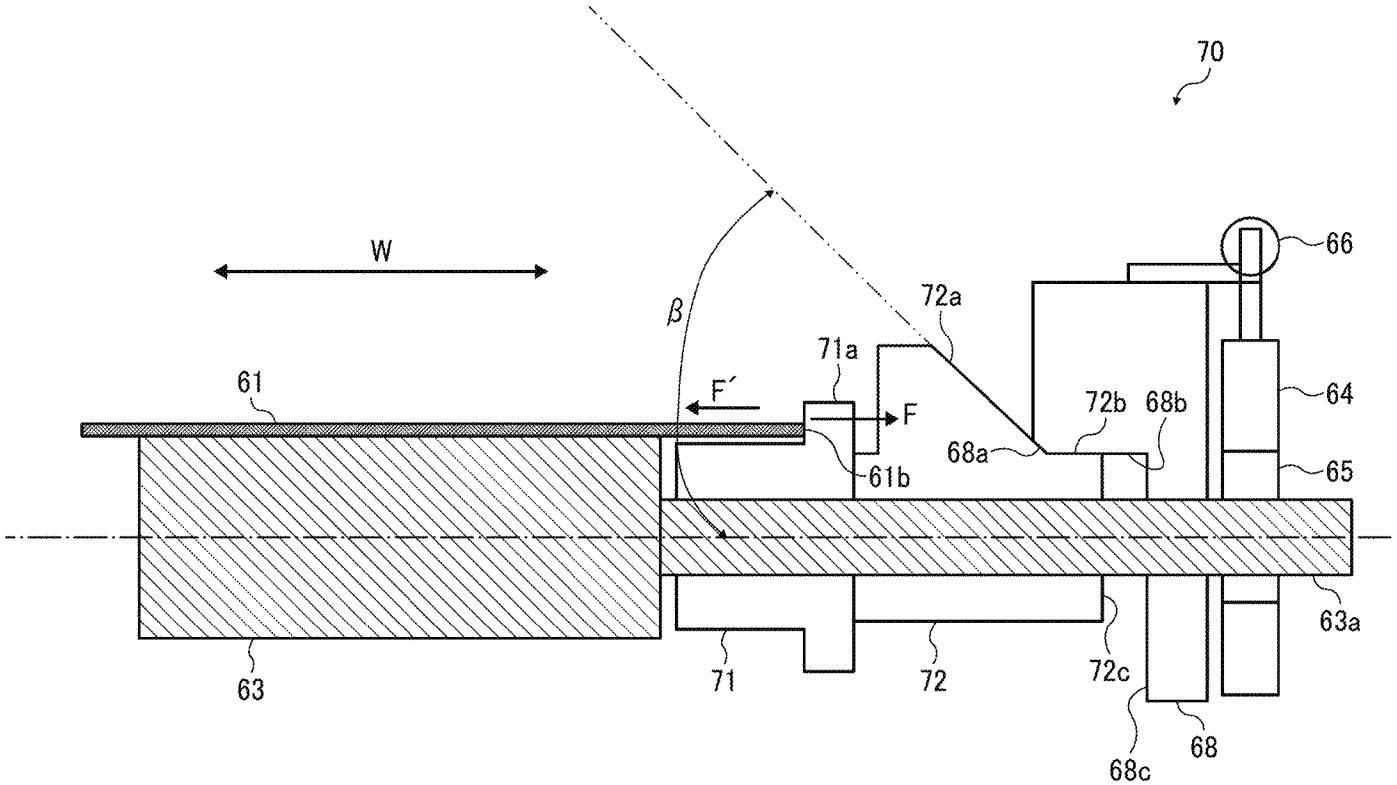
FIG. 5 is a cross-sectional view along a rotary shaft of the separation roller and schematically illustrates the shaft inclining device immediately after being assembled.

FIG. 5 is a cross-sectional view illustrating the shaft inclining device 70 of the belt device 60 along the rotary shaft 63*a* of the separation roller 63.

A belt deviation detector 71 and the shaft inclining member 72 are disposed on the rotary shaft 63*a* between the separation roller 63 and the shaft bearing 65. The belt deviation detector 71 and the shaft inclining member 72 constitute an axial-direction displacement device. The belt deviation detector 71 includes a flange 71*a* that contacts an end portion of the secondary transfer belt 61. As the secondary transfer belt 61 moves in a belt width direction and the end portion of the secondary transfer belt 61 contacts the flange 71*a*, exerting a force on the belt deviation detector 71 in the direction indicated by arrow F in FIG. 6, the belt deviation detector 71 moves along the rotary shaft 63*a* of the separation roller 63 toward the end of the rotary shaft 63*a*. As the belt deviation detector 71 moves outward in the axial direction along the rotary shaft 63*a*, the shaft inclining member 72 which is disposed outside the belt deviation detector 71 on the rotary shaft 63*a* moves outward in the axial direction along the rotary shaft 63*a*. In the meantime, the secondary transfer belt 61 receives a reaction force in a direction indicated by arrow F' in FIG. 6 from the flange 71*a*. Accordingly, a portion of the secondary transfer belt 61 positioned between the separation roller 63 and the secondary transfer roller 62 (i.e., a portion of the secondary transfer belt 61 that is not in contact with the separation roller 63 or the secondary transfer roller 62) may crease.

The belt device 60 according to the present embodiment includes the separation roller 63 rotatable together with the rotary shaft 63*a* to support the secondary transfer belt 61 and a shaft inclining member 72 to displace the rotary shaft 63*a* in the predetermined direction in conjunction with the deviation of the secondary transfer belt 61 in the axial direction W. The arm spring 66 urges the rotary shaft 63*a* to be displaced in a direction opposite to the predetermined direction.

The belt device 60 according to the present embodiment further includes the belt deviation detector 71 and the shaft inclining member 72. The belt deviation detector 71 contacts an end face 61*b* of the secondary transfer belt 61 and is displaced in the axial direction W in conjunction with the deviation of the secondary transfer belt 61 in the axial direction W. The shaft inclining member 72 contacts the belt deviation detector 71 and is displaced in conjunction with the belt deviation detector 71 in the axial direction W.

In the present uncomplicated embodiment, it is possible to convert a force generated by the deviation of the secondary transfer belt 61 to a force to displace the shaft inclining member 72.

A contact portion 68*a* of the frame 68 contacts a slanted surface 72*a* of the shaft inclining member 72 from outside the rotary shaft 63*a* in the axial direction. The end portion of the rotary shaft 63*a* of the separation roller 63 on which the shaft inclining member 72 is disposed is supported, via the shaft bearing 65, by the shaft support arm 64. The shaft support arm 64 is urged by the arm spring 66. Thus, the end portion of the rotary shaft 63*a* of the separation roller 63 is urged upward in FIG. 5. Accordingly, in a state in which the end portion of the secondary transfer belt 61 is not in contact with the flange 71*a* of the belt deviation detector 71, a contact position between the contact portion 68*a* of the frame 68 and the slanted surface 72*a* of the shaft inclining member 72 is regulated at position at which a first stopper surface 68*b* of the frame 68 contacts a contact surface 72*b* of the shaft inclining member 72 by the spring force of the arm spring 66. The contact surface 72*b* of the shaft inclining member 72 is continuous with the lower end of the slanted surface 72*a*. That is, the contact portion 68*a* of the frame 68 is held in a state in which the contact portion 68*a* contacts the lower end portion of the slanted surface 72*a* of the shaft inclining member 72.

Figure 6:
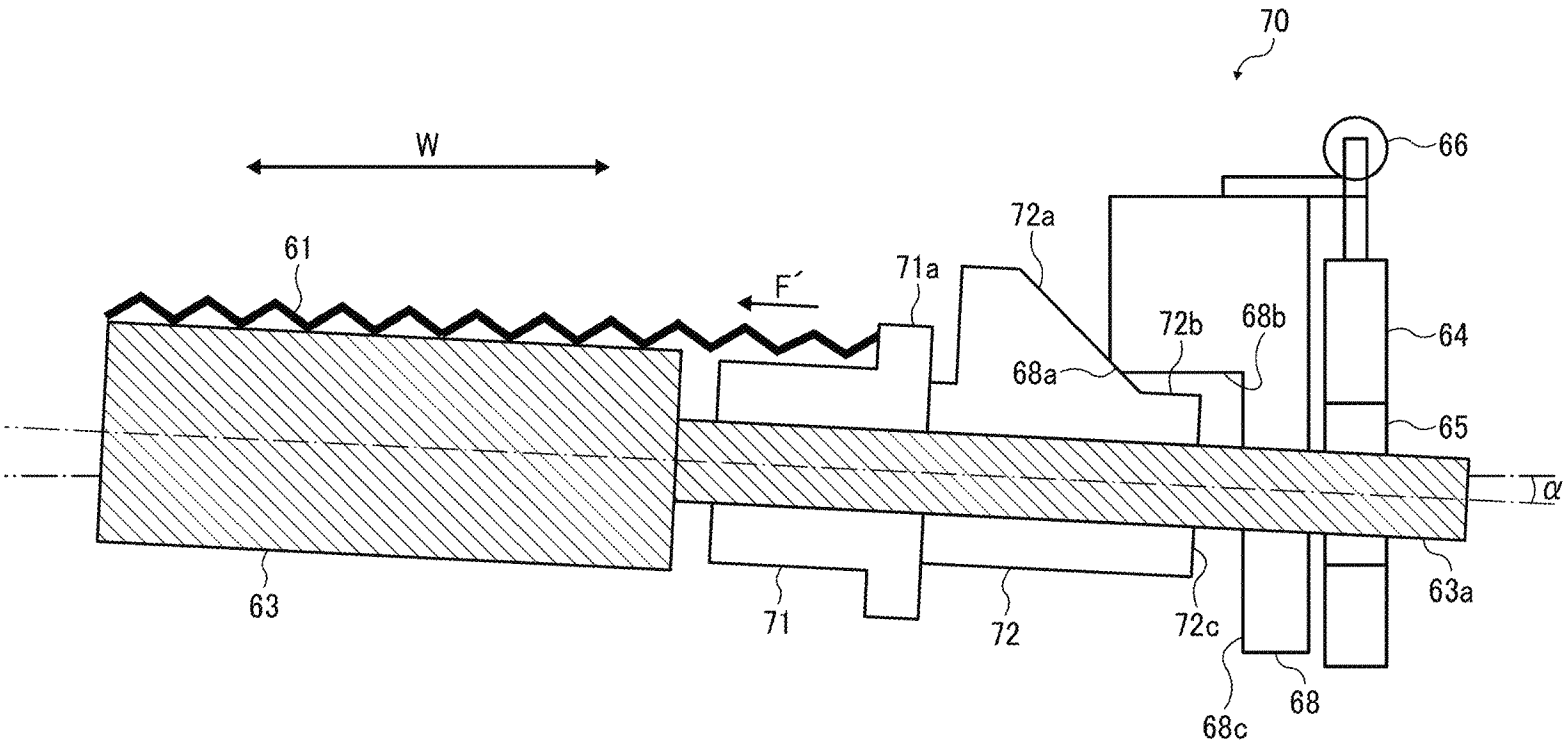
FIG. 6 is a cross-sectional view along the rotary shaft of the separation roller and schematically illustrates the shaft inclining device after belt deviation correction.

In this state, if the secondary transfer belt 61 receives a force causing the secondary transfer belt 61 to move in the belt width direction, the belt deviation detector 71 and the shaft inclining member 72 move outward in the axial direction along the rotary shaft 63*a*. As a result, the contact portion 68*a* of the frame 68 relatively moves along the slanted surface 72*a* of the shaft inclining member 72. The contact position at which the slanted surface 72*a* of the shaft inclining member 72 contacts the contact portion 68*a* of the frame 68 moves up towards the upper portion of the slanted surface 72*a*. As a result, the axial end portion of the rotary shaft 63*a* of the separation roller 63 in a direction of deviation of the secondary transfer belt 61 is pressed down against the urging force of the arm spring 66 as illustrated in FIG. 6. At that time, an opposite end portion of the secondary transfer belt 61 is not in contact with the flange 71*a* of the belt deviation detector 71. Accordingly, as illustrated in FIG. 5, the contact portion 68*a* of the frame 68 is held in contact with the contact surface 72*b* of the shaft inclining member 72. The end portion of the rotary shaft 63*a* of the separation roller 63 in the direction of deviation of the secondary transfer belt 61 is pressed down relative to the other end, causing the rotary shaft 63*a* to incline.

As the rotary shaft 63*a* of the separation roller 63 inclines further, the moving speed of the secondary transfer belt 61 in the belt width direction slows down gradually, and ultimately the secondary transfer belt 61 moves to the opposite direction in the belt width direction. As a result, the position of the secondary transfer belt 61 in the belt width direction returns gradually, thereby running the secondary transfer belt 61 on track and enabling the secondary transfer belt 61 to travel reliably. The same is true for the case in which the direction of deviation of the secondary transfer belt 61 is in the direction opposite to the direction described above.

Figure 7:
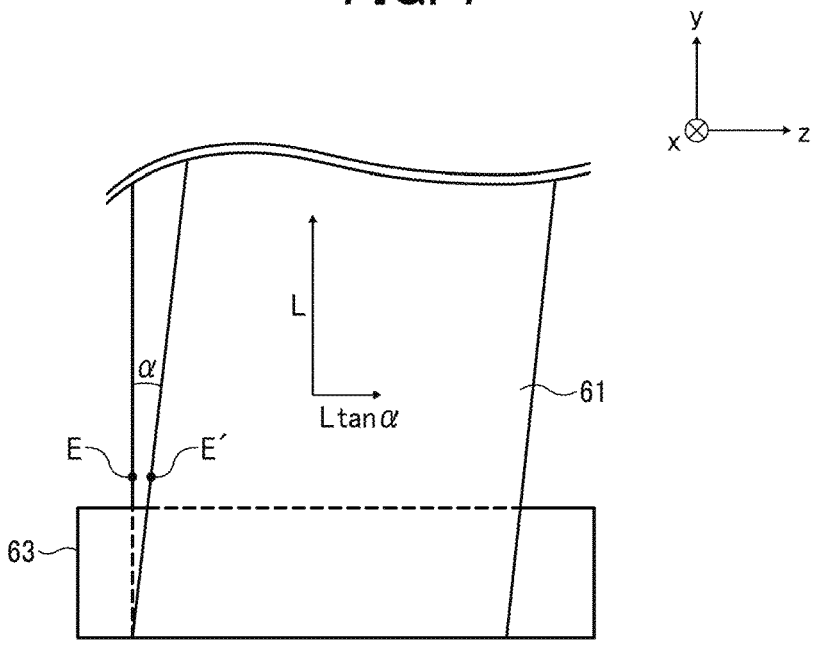
FIG. 7 is a conceptual diagram illustrating an example of deviation of the secondary transfer belt of the belt device.

With reference to FIG. 7, a description is provided of a principle of correction of belt deviation by inclining the rotary shaft 63*a* of the separation roller 63.

FIG. 7 is a conceptual diagram illustrating deviation of the secondary transfer belt 61. Here, it is assumed that the secondary transfer belt 61 has a rigid body, and an arbitrary point (i.e., a point E on the belt end portion) on the secondary transfer belt 61 before advancing to the separation roller 63 is observed. As long as two rollers, i.e., the secondary transfer roller 62 and the separation roller 63 around which the secondary transfer belt 61 is stretched taut, are completely horizontal or parallel to each other, the position of the secondary transfer belt 61 in the axial direction of the separation roller 63 does not change between the point E on the secondary transfer belt 61 immediately before advancing to the separation roller 63 and a point E' corresponding to the point E immediately after exiting the separation roller 63. In this case, the secondary transfer belt 61 is not drawn to one side in the axial direction.

By contrast, in the case in which the rotary shaft 63*a* of the separation roller 63 is inclined at an inclination angle a relative to the rotary shaft 62*a* of the secondary transfer roller 62, the point E on the secondary transfer belt 61 shifts by an amount of tan $\alpha$ in the axial direction of the separation roller 63 while moving along the peripheral surface of the separation roller 63 as illustrated in FIG. 7. Therefore, by inclining the rotary shaft 63*a* of the separation roller 63 by the inclination angle $\alpha$ relative to the rotary shaft 62*a* of the secondary transfer roller 62, the position of the secondary transfer belt 61 in the belt width direction can be moved approximately by the amount of tan $\alpha$ in accordance with the rotation of the separation roller 63.

The amount of belt deviation (moving speed in the belt width direction) of the secondary transfer belt 61 is proportional to the inclination angle $\alpha$. That is, the amount of deviation to one side of the secondary transfer belt 61 increases as the inclination angle $\alpha$ increases, and the amount of deviation to one side decreases as the inclination angle $\beta$ decreases. For example, in the case in which the secondary transfer belt 61 is drawn to the right side as illustrated in FIG. 6, the belt deviation causes the shaft inclining member 72 to move in the axial direction of the separation roller 63, thereby moving the rotary shaft 63*a* of the separation roller 63 down in FIG. 6 and thus bringing the secondary transfer belt 61 back to the left in FIG. 6. Then, the belt deviation can be corrected and the secondary transfer belt 61 is adjusted at the position where the initial deviation (i.e., to the right in FIG. 5) of the secondary transfer belt 61 is balanced with the opposite deviation caused by inclining the rotary shaft 63*a* of the separation roller 63. In the event the secondary transfer belt 61 traveling at the balanced position starts to deviate to either side, the inclination of the rotary shaft 63*a* of the separation roller 63 in accordance with the deviation of the secondary transfer belt 61 brings the secondary transfer belt 61 to the balanced position again.

According to the present embodiment, the shaft inclining device 70 of the belt device 60 inclines the rotary shaft 63*a* of the separation roller 63 by the inclination angle corresponding to the amount of deviation of the secondary transfer belt 61 in the belt width direction. Accordingly, deviation of the secondary transfer belt 61 is corrected fast. Furthermore, in order to incline the rotary shaft 63*a* of the separation roller 63, the moving force of the secondary transfer belt 61 moving in the belt width direction is used so that an additional drive source such as a motor is not necessary, and hence no extra space is needed to accommodate the drive source. The rotary shaft 63*a* of the separation roller 63 can be inclined with a simple configuration without a dedicated drive source.

Next, a description is provided of the shaft inclining member 72.

Figure 8:
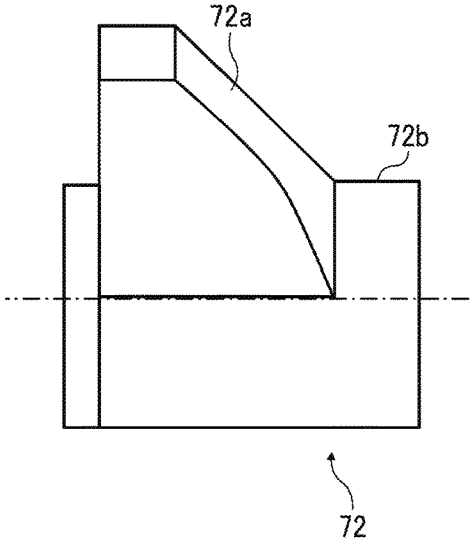
FIG. 8 is a perspective view of a shaft inclining member of the shaft inclining device.

FIG. 8 is a schematic perspective view illustrating the shaft inclining member 72 according to the present embodiment. In the present embodiment, the shaft inclining member 72 has a cylindrical main body, and a projection having the slanted surface 72*a* projects from the outer circumferential surface of the cylindrical body. The slanted surface 72*a* is curved to conform to the surface of a conical shape coaxial with the axis of the cylindrical body.

There are two reasons for forming the slanted surface 72*a* with a curved surface. The first reason is that even when the shaft inclining member 72 rotates slightly around the rotary shaft 63*a* of the separation roller 63, the angle of inclination of the separation roller 63 does not change. The second reason is that the curved surface of the slanted surface 72*a* allows the slanted surface 72*a* and the contact portion 68*a* of the frame 68 to make a point contact, thereby reducing friction at the contact place. With this configuration, the contact pressure at the end portion of the secondary transfer belt 61 contacting the belt deviation detector 71 is reduced, thereby reducing damage to the end portion of the secondary transfer belt 61 and hence achieving extended belt life expectancy. According to the present embodiment, the slanted surface 72*a* is inclined at an inclination angle β of approximately 30° relative to the rotary shaft 63*a*. Preferred material of the shaft inclining member 72 includes, but is not limited to, polyacetal (POM).

A bending stress acts repeatedly on the end portion of the outer circumferential surface and of the inner circumferential surface of the secondary transfer belt 61 due to contact with the belt deviation detector 71, thus resulting in damage or breakage of the secondary transfer belt 61. In terms of durability of the secondary transfer belt 61, in some embodiments, a reinforcing tape is adhered around the end portion of at least one of the inner and outer circumferential surfaces of the secondary transfer belt 61.

According to the present embodiment, the outward movement of the shaft inclining member 72 in the axial direction is restricted to a certain range. More specifically, an outer end surface 72*c* (illustrated in FIG. 5) of the shaft inclining member 72 in the axial direction comes in contact with a second stopper surface 68*c* of the frame 68, thereby preventing the shaft inclining member 72 from moving further outside in the axial direction. In the present embodiment, the second stopper surface 68*c* of the frame 68 restricts the outward movement of the shaft inclining member 72 in the axial direction. Alternatively, the shaft support arm 64 or the shaft bearing 65 can restrict the outward movement of the shaft inclining member 72 in the axial direction.

It should be noted that the arm spring 66 also supports weight of the separation roller 63, the rotary shaft 63*a* thereof, the belt deviation detector 71, and the shaft inclining member 72 via the shaft support arm 64.

In other embodiments, the arm spring 66 can be directly attached to the shaft inclining member 72. In FIG. 5, the belt deviation detector 71 may not always be in contact with the secondary transfer belt 61. Further, the belt deviation detector 71 and the shaft inclining member 72 can be united as a single member. In the present embodiment, a displacement direction of the shaft inclining member 72 (the vertical direction in FIG. 5) and a displacement direction of the rotary shaft 63*a* are identical, but due to the layout of members and the like, the displacement directions of both can be shifted by a predetermined angle.

In the present embodiment, the intermediate transfer belt 51 that travels while contacting the outer circumferential surface of the secondary transfer belt 61 is also formed into an endless loop. Consequently, it is possible that, similar to the secondary transfer belt 61, the intermediate transfer belt 51 travels out of alignment. Thus, the intermediate transfer belt 51 is provided with a belt alignment device to correct deviation of the intermediate transfer belt 51.

The shaft inclining device 70 serving as the belt alignment device of the belt device 60 can be employed as the belt alignment device for the intermediate transfer belt 51.

Figure 9:
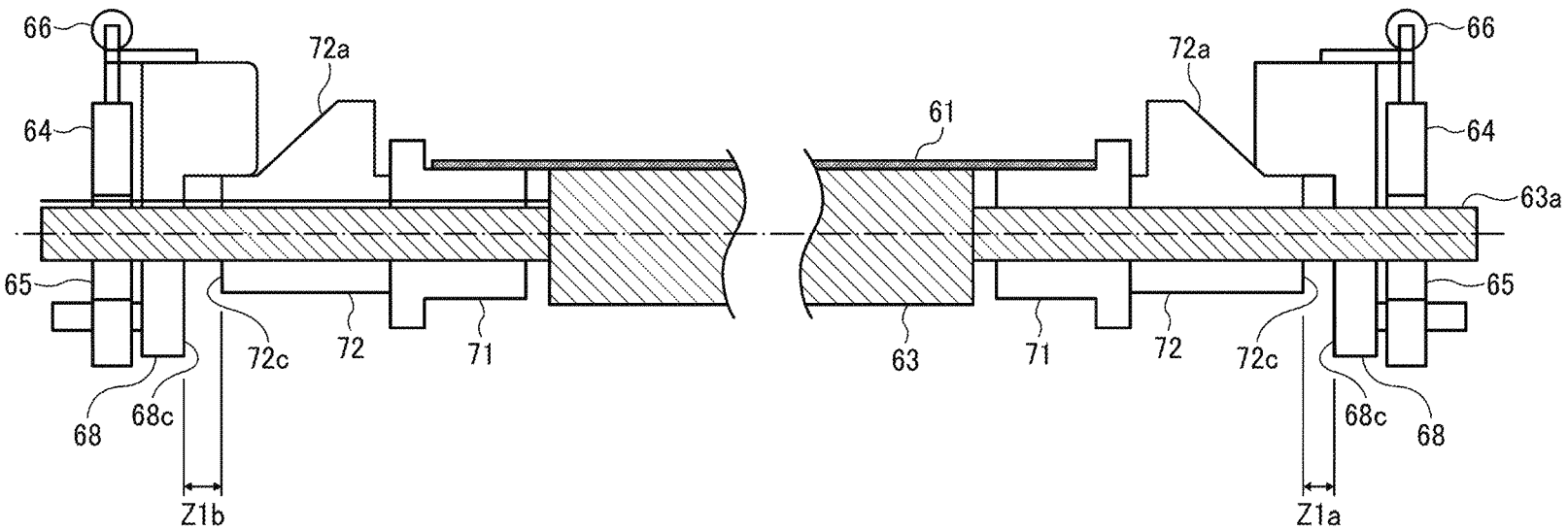
FIG. 9 is a cross-sectional view illustrating maximum displacement of the secondary transfer belt in the belt width direction.

As described above, in order to control the displacement amount of the shaft inclining member 72 in the axial direction within a permissible range, the frame 68 includes the second stopper surface 68*c*. As illustrated in FIG. 9, the shaft inclining member 72 disposed at both ends of the secondary transfer belt 61 is movable in a space Z1*a* and in a space Z1*b* between the outer end surface 72*c* of the shaft inclining member 72 in the axial direction and the second stopper surface 68*c* of the frame 68. This configuration allows the separation roller 63 to incline by an amount corresponding to the amount of displacement of the shaft inclining member 72 in the axial direction. The maximum amount of displacement of the secondary transfer belt 61 in the belt width direction coincides with a sum of the space Z1*a* and the space Z1*b* between the outer end surface 72*c* in the axial direction of the shaft inclining member 72 disposed outside both ends of the secondary transfer belt 61 and the second stopper surface 68*c* of the frame 68.

Figure 10:
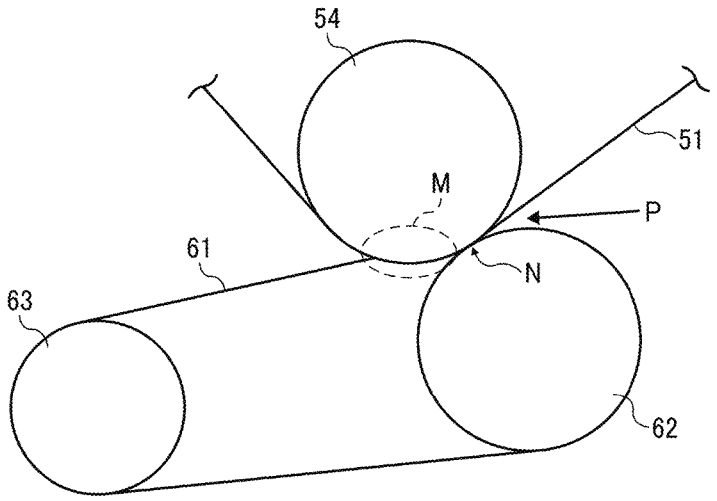
FIG. 10 is a schematic view illustrating a configuration around a secondary transfer nip of the belt device.

Next, with reference to FIG. 10, a description is provided of a configuration around the secondary transfer nip according to the present embodiment.

FIG. 10 is a schematic view illustrating a configuration around the secondary transfer nip. In FIG. 10, a portion of the secondary transfer belt 61 pressed against the intermediate transfer belt 51 by the secondary transfer roller 62 is a secondary transfer nip N. A portion of the secondary transfer belt 61 adjoining the secondary transfer nip N of the secondary transfer belt 61 at the downstream side in the direction of travel of the secondary transfer belt 61 and contacting the intermediate transfer belt 51 is a contact portion M.

As the secondary transfer belt 61 contacts the belt deviation detector 71, the secondary transfer belt 61 may crease. However, tension is applied to the contact portion M of the secondary transfer belt 61 by the intermediate transfer belt 51, thereby keeping the contact portion M stretched. When the contact portion M does not crease, a small space that causes an electrical discharge due to dielectric breakdown is not produced between the outer circumferential surface of the secondary transfer belt 61 and the recording sheet P near the secondary transfer nip N. With this configuration, image defects due to the electrical discharge caused by dielectric breakdown are prevented.

The belt device 60 is described in further detail below.

Figure 2:
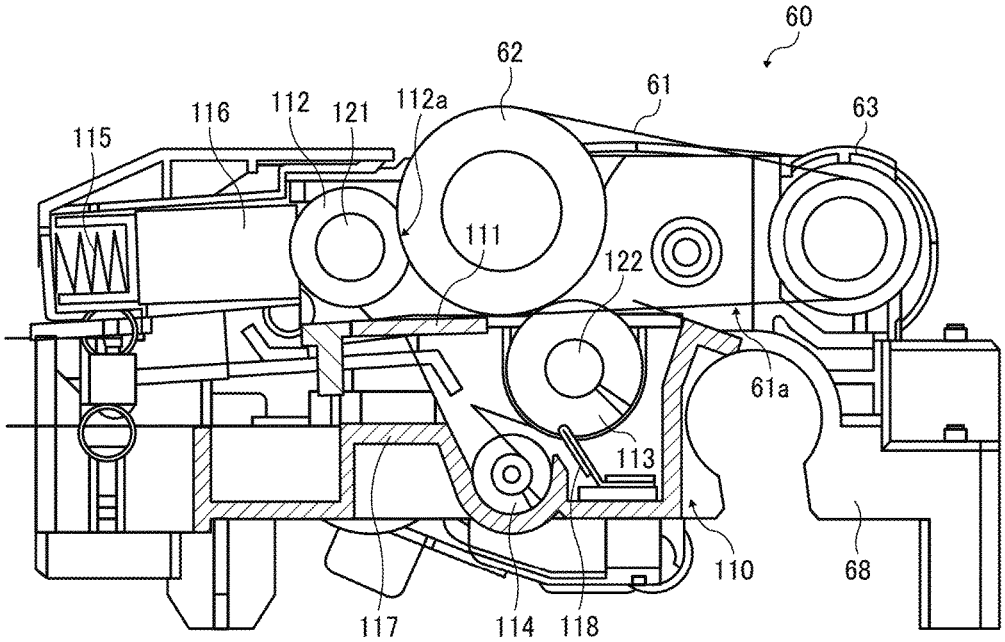
FIG. 2 is a schematic view of a belt device of the image forming apparatus in FIG. 1.

As illustrated in FIG. 2, the belt cleaning device 110 included in the belt device 60 includes a cleaning blade 111 as a cleaner, a lubricant application brush 112 as a lubricant applicator, a paper-dust removing brush 113 as a cleaner, and a waste screw 114 as a waste conveyance member. A case 117 as a receiving portion is disposed below the cleaning blade 111 and the paper-dust removing brush 113.

The cleaning blade 111 is disposed such that one end side thereof is secured to the frame 68 and the other end side is in contact with the surface (referred to as a belt surface) 61*a* of the secondary transfer belt 61. The cleaning blade 111 scrapes off residual toner adhering to the belt surface 61*a*.

The lubricant application brush 112 is provided on the frame 68 of the belt device 60 so as to be in contact with the belt surface 61*a*. The lubricant application brush 112, which is rotatable together with a support shaft 121 extending in the axial direction W, has a contact portion 112*a* and is supported by the support shaft 121 and contacts the belt surface 61*a* (secondary transfer belt 61).

The lubricant application brush 112 presses against the lubricant 116 urged toward the lubricant application brush 112 with the spring 115. The lubricant application brush 112 rotates to scrape off the lubricant 116 and apply the lubricant 116 to the belt surface 61*a*, thereby minimizing abrasion of the cleaning blade 111 and the secondary transfer belt 61. In the present embodiment, the contact member is the lubricant applicator (i.e., lubricant application brush 112) for applying the lubricant 116 to the secondary transfer belt 61 (belt).

The paper-dust removing brush 113 is in contact with the belt surface 61*a* and removes paper dust which is foreign substances adhering to the belt surface 61*a* by rotation thereof. A blade 118 sweeps down paper dust attached to the paper-dust removing brush 113. Residual toner and paper dust removed from the belt surface 61*a* by the cleaning blade 111 or the paper-dust removing brush 113 are accommodated and accumulated in the case 117.

The waste screw 114 is disposed below the cleaning blade 111 and the paper-dust removing brush 113 to transport the residual toner and paper dust accumulated in the case 117 from the belt cleaning device 110 to the waste toner container.

In FIG. 2, the surfaces of the lubricant application brush 112 and the paper-dust removing brush 113 are not elastically deformed. However, in the belt device 60, the lubricant application brush 112 and the paper-dust removing brush 113 are actually pressed against the belt surface 61*a* in a state of being elastically deformed by a predetermined amount.

The lubricant 116 applied to the belt surface 61*a* of the secondary transfer belt 61 by the lubricant application brush 112 reduces an adhesion force between substances and the belt surface 61*a*. Therefore, the residual toner and paper dust adhering to the belt surface 61*a* of the secondary transfer belt 61 are easily separated and scraped off by the cleaning blade 111 and the paper-dust removing brush 113.

Figure 11:
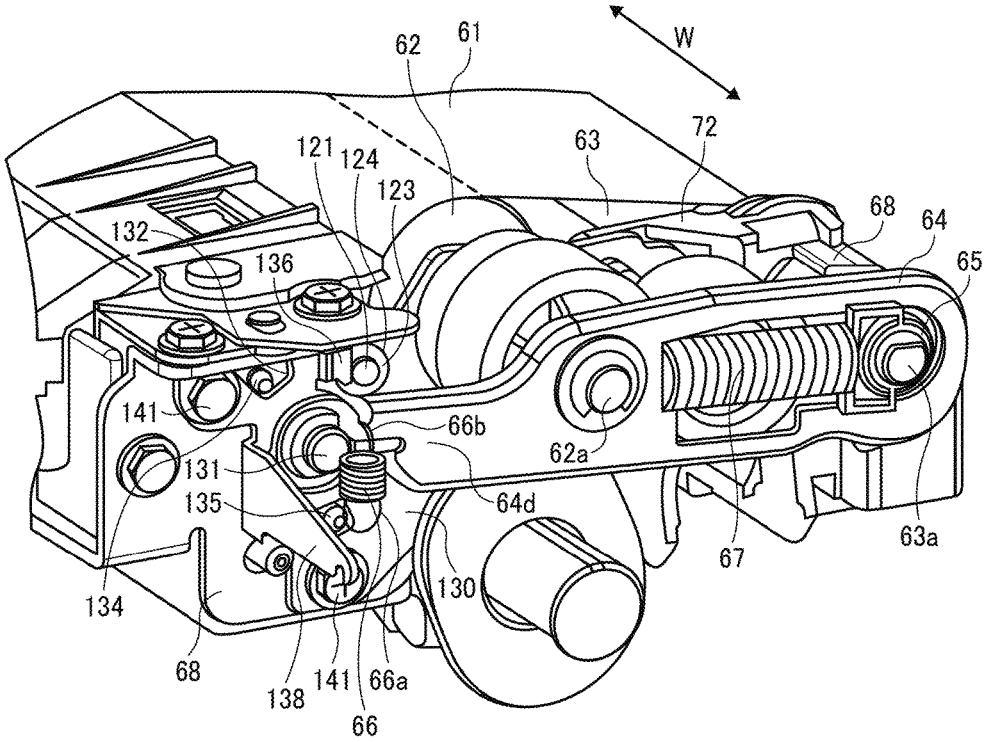
FIG. 11 is a perspective view illustrating a configuration of a characteristic portion of the belt device.
Figure 12A:
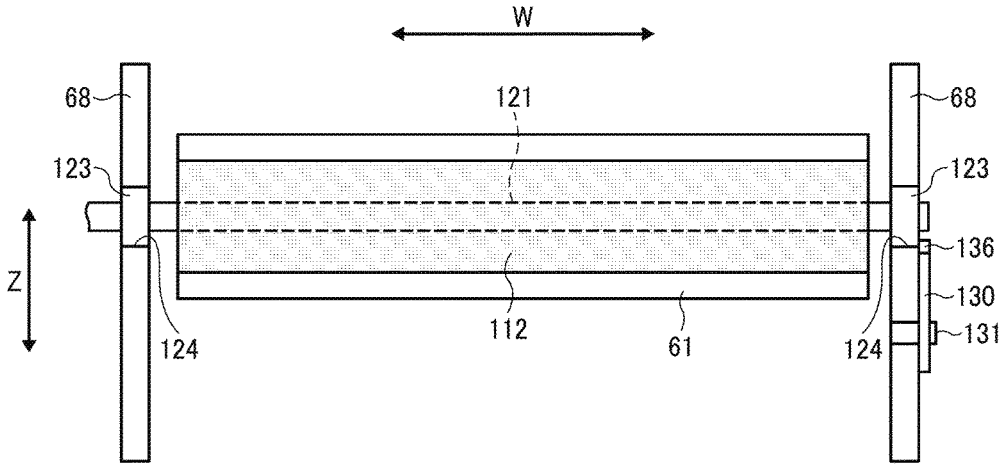
FIGS. 12A and 12B are schematic views illustrating a regulating position and a releasing position of the regulating member, and the removal in the axial direction of a contact member.

The lubricant application brush 112 and the paper-dust removing brush 113 include support shafts 121 and 122 to support the lubricant application brush 112 and the paper-dust removing brush 113, respectively. The lubricant application brush 112 rotates together with the support shafts 121, and the paper-dust removing brush 113 rotates together with the support shafts 122. As illustrated in FIGS. 11 and 12A, the support shaft 121 of the lubricant application brush 112 is rotatably supported by rolling element bearings as bearings disposed at the attachment portions 124 formed on the frames 68 disposed facing each other in the axial direction. The rolling element bearing is a ball bearing 123 in the present embodiment. The ball bearings 123 are attached to the attachment portions 124 so as not to be likely to move in the vertical direction Z, which is the direction perpendicular to the axial direction W, but to be movable in the axial direction W with respect to the frame 68. Therefore, the lubricant application brush 112 can be attached to and detached from the frame 68 together with the ball bearings 123 as needed.

The paper-dust removing brush 113 is rotatably supported on the frames 68 via ball bearings 125 as bearings in the axial direction W of the support shaft 122, and is movable in the axial direction W. Note that, FIG. 11 illustrates a configuration of a side portion, on which the shaft inclining device 70 is disposed, of the belt device 60.

In the printer 100 including the belt device 60 employing the secondary transfer belt 61, it is possible to improve the separability of the recording sheet P and to improve the transportability of the recording sheet P, so that an image failure can be minimized. Additionally, it is possible to improve the color stability by measuring the toner density on the secondary transfer belt 61. Generally, the secondary transfer belt 61 is likely to move to one side in the width direction (axial direction W) of the secondary transfer belt 61 (belt deviation) or repeatedly wander back and forth on either side in the width direction of the secondary transfer belt 61. Such deviation of the secondary transfer belt 61 (including belt walk) is attributed to dimensional tolerance of parts constituting the belt device 60, for example, variations in a parallelism error of the secondary transfer roller 62 and separation roller 63 as the plurality of support rollers that supports the secondary transfer belt 61, variations in an outer diameter of the rollers, and variations in the tension of the secondary transfer belt 61 due to changes in the circumferential length of the secondary transfer belt 61 itself.

Therefore, according to the present embodiment, the shaft inclining device 70 of the belt device 60 inclines the rotary shaft 63*a* by the inclination angle corresponding to the amount of deviation of the secondary transfer belt 61 in the belt width direction (axial direction W), thereby promptly correcting the deviation of the secondary transfer belt 61. With such a configuration that merely includes the shaft inclining device 70 and the lubricant application brush 112, it is necessary to have a dedicated configuration for each of the mechanism for applying the lubricant 116 and the mechanism for holding the secondary transfer belt 61, thereby increasing the space and the number of parts.

In addition, when the lubricant application brush 112 is movable in the axial direction W (the belt width direction) in consideration of the detachability (ease of replacement) of the lubricant application brush 112, the lubricant application brush 112 moves in the axial direction during rotation of the brush, thereby changing the application position of the lubricant 116. There is room for improvement in terms of the ease of replacement. Here, the secondary transfer belt 61 is used as the belt, and the lubricant application brush 112 is exemplified as a contact member that contacts the secondary transfer belt 61. However, with other configurations, in the case of a structure that can be moved in the axial direction, it is necessary to improve the positioning in use and the ease of replacement of the contact member.

Therefore, according to the present embodiment, the belt device 60 includes a regulating member 130 to regulate the movement of the support shaft 121 in the axial direction W. The regulating member 130 is disposed on the frame 68 and moves between the regulating position illustrated in FIG. 13 and the releasing position illustrated in FIG. 14. The regulating member 130 in the regulating position regulates the rotary shaft 63*a* to move in the axial direction W, and the regulating member 130 in the releasing position allows the rotary shaft to move in the axial direction W.

The regulating member 130 is made of a plate material and is swingable (rotatable) along the frame 68 around a fulcrum shaft 131 disposed on the frame 68. As illustrated in FIG. 11, the regulating member 130 is disposed in a space between one of the shaft support arms 64 and one of the frames 68, thereby minimizing increase of the size in the axial direction W of the belt device 60.

Figure 13:
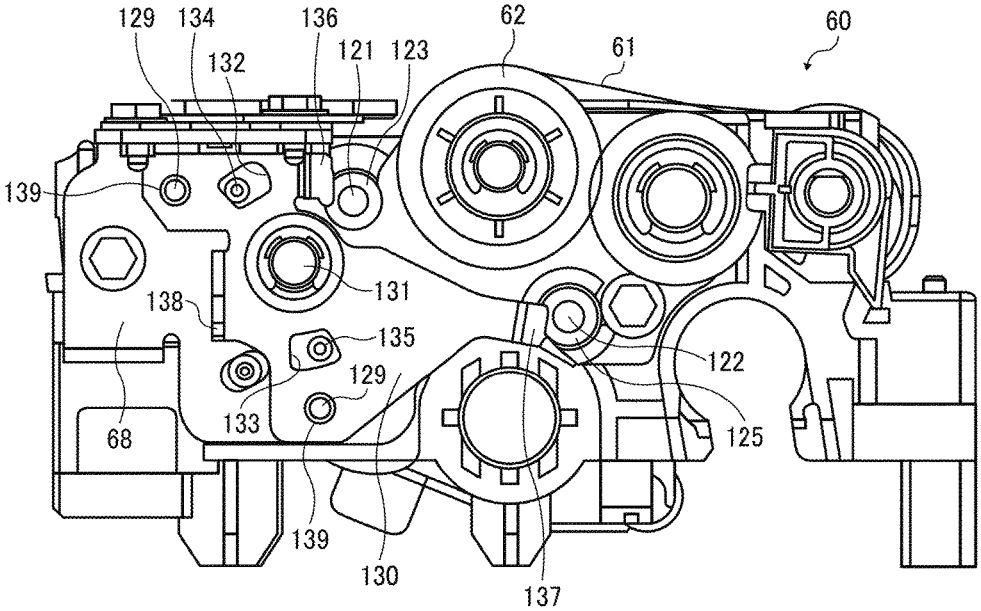
FIG. 13 is a schematic view illustrating the regulating position in which a support shaft is regulated by the regulating member.
Figure 14:
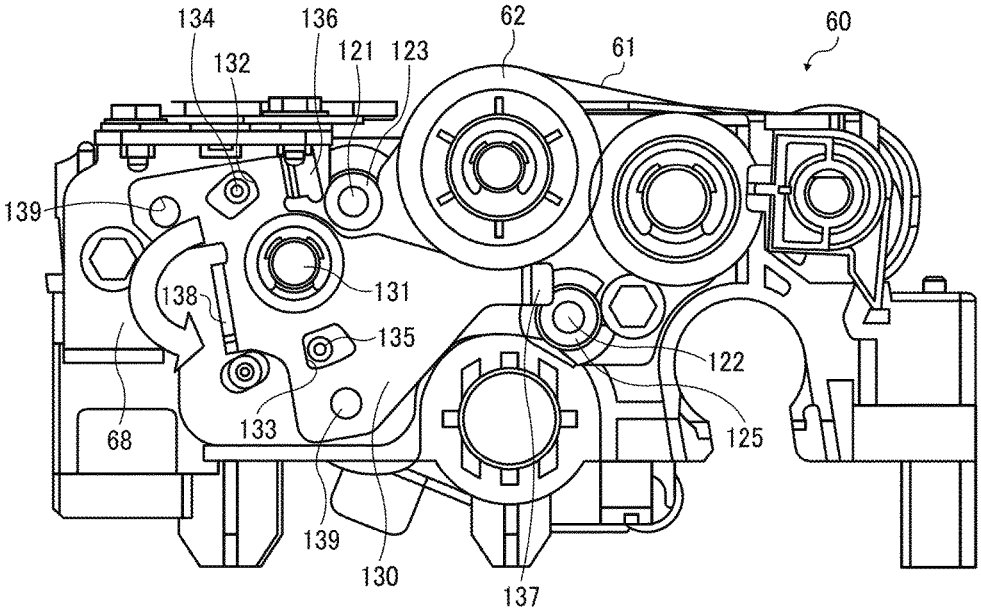
FIG. 14 is a schematic view illustrating the releasing position in which regulation of the support shaft by a regulating member is released.

As illustrated in FIGS. 13 and 14, the regulating member 130 has slots 132 and 133 extending in an arc around the fulcrum shaft 131 that accommodate bosses 134 and 135 concentrically disposed around the fulcrum shaft 131 on the frame 68. The slots 132 and 133 and the bosses 134 and 135 function as positioning members to position the regulating member 130 in the regulating position or the releasing position by regulating the movement of the regulating member 130 in the swinging direction. That is, the regulating member 130 can be separated from the support shaft 121 of the lubricant application brush 112.

In the present embodiment, the slots 132 and 133 and the bosses 134 and 135 are arranged to determine the position of the regulating member 130 in a direction same as the direction in which the regulating member 130 is moved to the regulating position (in the clockwise direction in FIG. 18) by the urging force of the arm spring 66.

The belt device 60 includes the secondary transfer belt 61, the lubricant application brush 112 (contact member), and the regulating member 130. The lubricant application brush 112 is rotatable together with the support shaft 121 extending in the axial direction W. The lubricant application brush 112 is supported by the support shaft 121 and contacts the secondary transfer belt 61 at the contact portion 112*a*. The regulating member 130 regulates the movement of the lubricant application brush 112 in the axial direction W. The regulating member 130 is displaced between the regulating position to regulate the movement of the support shaft 121 and the releasing position not to regulate the movement of the support shaft 121.

The belt device 60 includes frames 68. The ball bearings 123 are attached to the support shaft 121 supporting the lubricant application brush 112 (contact member). The ball bearings 123 are supported on the respective frames 68. The regulating member 130 in the regulating position is separated from the support shaft 121 and contacts the ball bearings 123.

The belt device 60 includes the arm spring 66 as an urging member that urges the regulating member 130 in the direction in which the regulating member 130 is displaced from the releasing position to the regulating position.

The regulating member 130 includes a first holding portion 136 and a second holding portion 137. The first holding portion 136 overlaps one ball bearing 123 of the lubricant application brush 112 as viewed from an end of the support shaft 121 in the axial direction, the second holding portion 137 overlaps one ball bearing 125 of the paper-dust removing brush 113 as viewed from an end of the support shaft 122 in the axial direction.

Figure 15:
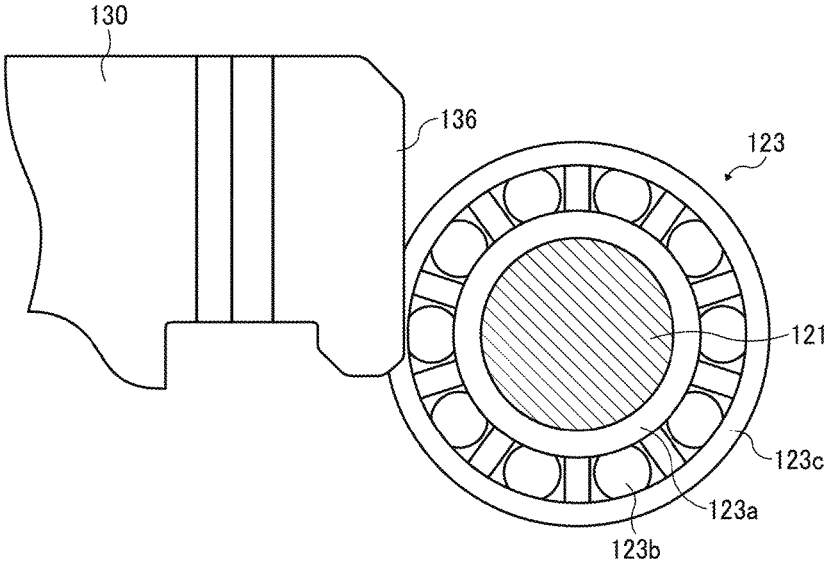
FIG. 15 is an enlarged view illustrating a regulation portion of a bearing by the regulating member.

When the regulating member 130 is in the regulating position illustrated in FIG. 13, the first holding portion 136 overlaps the ball bearing 123, and when the regulating member 130 is in the releasing position illustrated in FIG. 14, the first holding portion 136 does not overlap with the ball bearing 123. More specifically, as illustrated in FIG. 15, the ball bearing 123 includes an inner ring 123*a* to which the support shaft 121 is press-fitted, an outer ring 123*c*, and a rolling element 123*b* disposed between the inner ring 123*a* and the outer ring 123*c*. In a state where the regulating member 130 is in the regulating position, the first holding portion 136 overlaps the outer ring 123*c* without contact with the support shaft 121. That is, the regulating member 130 is configured to be free from contact with an outer periphery of the support shaft 121, to be separated from the inner ring 123*a*, and to contact the outer ring 123*c* when the regulating member 130 is at the regulating position at the regulating position.

When the regulating member 130 is in the regulating position, the first holding portion 136 contacts the end face of the ball bearing 123 from the outside in the axial direction W to make positioning in the axial direction W (that is, thrust direction) of the ball bearing 123. Accordingly, the first holding portion 136 positions the lubricant application brush 112 as the contact member and the support shaft 121 in the axial direction W (that is, the thrust direction). The first holding portion 136 (and the regulating member 130) is positioned on the frame 68 by a bolt 141 as a fastening member to be described later. The frame 68 supports the rotary shaft 62*a* of the secondary transfer roller 62. The secondary transfer belt 61 is supported by and entrained around the secondary transfer roller 62.

According to the present embodiment, it is possible to position the lubricant application brush 112 at a predetermined position in the belt device 60 with a simple configuration. In particular, according to the above-described configuration, the lubricant application brush 112 can be accurately positioned with respect to the surface of the secondary transfer belt 61 supported by the secondary transfer roller 62.

Even when the regulating member 130 is at the regulating position illustrated in FIG. 13 or the releasing position illustrated in FIG. 14, the second holding portion 137 always overlaps with the ball bearing 125. Similarly to the first holding portion 136, the second holding portion 137 is also disposed so as not to contact with an outer periphery of the support shaft 122 supported by the ball bearing 125 when the regulating member 130 is placed at the regulating position.

That is, the belt device 60 according to the present embodiment includes the support shaft 122 and the paper-dust removing brush 113 as the cleaner to clean the belt surface 61*a* of the secondary transfer belt 61, and the regulating member 130 regulates the movement of the support shaft 122 of the paper-dust removing brush 113 when the regulating member 130 is at the releasing position and at the regulating position.

The regulating member 130 includes a spring-loaded portion 138 that hooks one end 66*a* of the arm spring 66 as the urging member. As illustrated in FIG. 11, the other end 66*b* of the arm spring 66 is hooked on the end 64*d* of the shaft support arm 64. The arm spring 66 is bridged between the regulating member 130 and the shaft support arm 64 to urge the regulating member 130 to move toward the regulating position. At a time of using the printer 100, the belt device 60 is placed in a state where the arm spring 66 is hooked on the regulating member 130 and the shaft support arm 64. A barycenter of the regulating member 130 is set so that the regulating member 130 moves to the releasing position to move away from the support shaft 121 due to its own weight when the one end of the arm spring 66 is removed during maintenance.

In the present embodiment, the urging member to urge the regulating member 130 to the regulating position is the arm spring 66 used in the shaft inclining device 70. The direction in which the regulating member 130 is positioned on the frame 68 and the direction in which the regulating member 130 is urged by the arm spring 66 are the same.

The regulating member 130 includes mounting holes 139 penetrating the regulating member 130 toward the frame 68. In the frame 68, when the regulating member 130 takes the regulating position, screw holes 129 are disposed at positions matching the mounting holes 139. The regulating member 130 is screwed into the screw holes 129 through the mounting holes 139, for example, by bolts 141 used as fastening members as illustrated in FIG. 11, and is thereby secured to the frame 68 in the state of the regulating position. In the present embodiment, a direction in which the bolts 141 are tightened and the direction in which the regulating member 130 moves from the releasing position to the regulating position are the same. That is, in the present embodiment, as the bolts 141 are rotated clockwise respectively, also the regulating member 130 moves in the clockwise direction. In the configuration in which the regulating member 130 is secured to the frame 68 holding the regulating member 130 by the bolt 141, the direction in which the regulating member 130 is positioned on the frame 68 and the direction in which the regulating member 130 moves due to the fastening torque of the bolt 141 are the same.

That is, the belt device 60 according to the present embodiment includes the frames 68, the bolts 141 as fastening members to secure the regulating member 130 to the frame 68 facing the regulating member 130 in a state where the regulating member 130 is in the regulating position. The direction in which the regulating member 130 moves due to the fastening torque of the bolt 141 and the direction in which the regulating member 130 moves from the regulating position to the releasing position are the same.

Figure 12B:
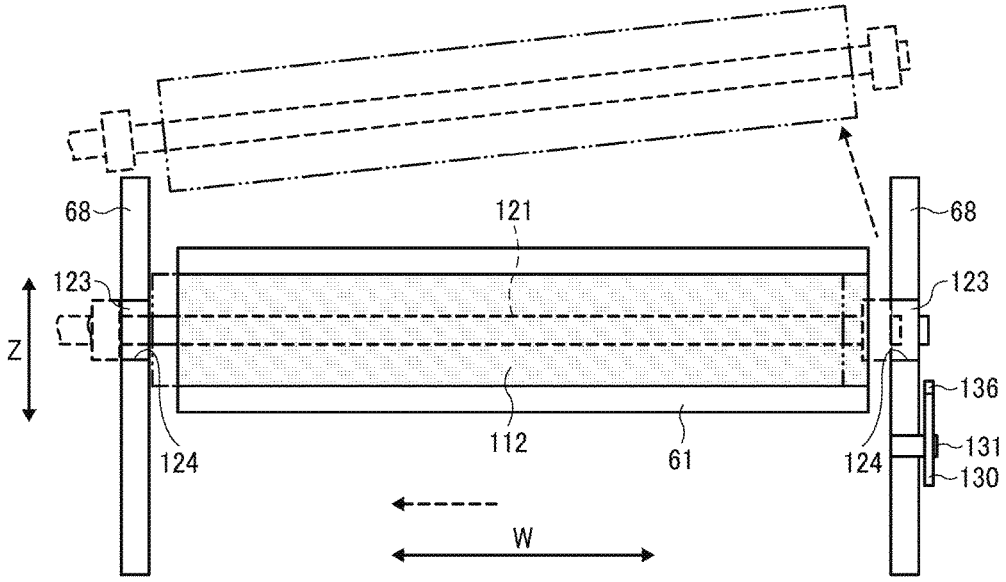

When the printer 100 is used, the regulating member 130 is in the regulating position. Accordingly, the first holding portion 136 overlaps with the ball bearing 123 and the second holding portion 137 overlaps with the ball bearing 125 as viewed from the end of support shafts 121 and 122 in the axial direction W in FIG. 13. Therefore, movement of the support shafts 121 and 122 in the axial direction W can be regulated by the first holding portion 136 and the second holding portion 137 of the regulating member 130 without using a shaft regulating member such as an E-ring (E-type retaining ring). Thus, positions of the lubricant application brush 112 and the paper-dust removing brush 113 are stabilized. In the case of replacement of the lubricant application brush 112, as the one end 66*a* of the arm spring 66 is removed from the spring-loaded portion 138 of the regulating member 130, the regulating member 130 moves from the regulating position illustrated in FIGS. 12A and 13 to the releasing position illustrated in FIGS. 12B and 14 by its own weight. Therefore, as illustrated in FIGS. 12B and 14, the lubricant application brush 112 can move in the axial direction W together with the ball bearing 123. Regulation of movement of the lubricant application brush 112 in the axial direction W can be easily released without removing the frames 68 or the E-ring. Therefore, the ease of replacement can be improved and assembly is facilitated. In the present embodiment, when the one end 66*a* of the arm spring 66 is removed from the spring-loaded portion 138 of the regulating member 130, the regulating member 130 moves by its own weight from the regulating position to the releasing position, but the present disclosure is not limited thereto. For example, the regulating member 130 can be moved (displaced) from the regulating position to the releasing position by the operation of a user or a service staff, when the one end 66*a* of the arm spring 66 is removed from the spring-loaded portion 138 of the regulating member 130. In this case, it is more preferable to have a snap fit or a hook pin or the like for holding the regulating member 130 in the releasing position illustrated in FIG. 14.

As illustrated in FIG. 13, when the regulating member 130 is in the regulating position, the regulating member 130 is separated from the support shaft 121. Accordingly, the regulating member 130 does not hinder rotation of the lubricant application brush 112 as the contact member. Further, even when the belt device 60 is used for a long period of time, the configuration thereof prevents wear due to sliding of the support shaft 121 and the regulating member 130, and regulation of support shaft 121 by the regulating member 130 can be reliably performed.

As illustrated in FIG. 15, when the regulating member 130 is in the regulating position, the regulating member 130 is separated from the inner ring 123*a* and is in contact with the outer ring 123*c*. Therefore, it is possible to stably rotate the lubricant application brush 112 without interfering with rotation of the support shaft 121 and the inner ring 123*a* press-fitted with the support shaft 121.

According to the configuration of the present embodiment, the lubricant application brush 112 reliably contacts the secondary transfer belt 61 to apply the lubricant 116 to the target position of the secondary transfer belt 61 by regulating the movement in the axial direction W of the lubricant application brush 112 as the lubricant applicator. Further, according to the configuration of the present embodiment, replacement of the lubricant 116 can be eased.

The other end 66*b* of the arm spring 66 as the urging member to urge the regulating member 130 to the regulating position is hooked on the end 64*d* of the existing shaft support arm 64. Accordingly, there is no need to form new spring loaded portion. Therefore, the number of parts can be minimized, and cost reduction and space saving of the belt device 60 can be achieved. That is, correction of deviation of the secondary transfer belt 61 and positioning of the lubricant application brush 112 in the axial direction W can be compatible without increasing the space and the number of parts. From another viewpoint, it is possible to achieve cost reduction and space saving by utilizing the spring-loaded portion 138 as the regulating member 130 to hook the one end 66*a* of the arm spring 66 while the other end 66*b* is hooked to the end 64*d* of the existing shaft support arm 64.

As illustrated in FIG. 14, even when the regulating member 130 is at the releasing position in which the overlapping with the ball bearing 123 is released, the overlapping state with the ball bearing 125 is maintained. Therefore, the regulating member 130 can prevent a plurality of components disposed around the secondary transfer belt 61 from moving in the axial direction W. Therefore, the number of parts can be minimized and the cost is reduced as compared with the case of individually providing a regulating member. Further, even if the lubricant application brush 112 can move in the axial direction W, the position of the paper-dust removing brush 113 in the axial direction W is regulated. Therefore, the regulating member 130 can prevent the plurality of components from being detached from the frames 68 at the same time. With this configuration, it is possible to prevent the parallelism of the frames 68 and the positional relation with other parts from being disturbed.

That is, according to the configuration of the present embodiment, movement of the paper-dust removing brush 113 in the axial direction W can be regulated by the regulating member 130 in both the regulating position and the releasing position. In addition, it is possible to regulate the position of the paper-dust removing brush 113 with a simple configuration at the time of replacement and mounting of the contact member (lubricant application brush 112).

Particularly, it is more preferable to adopt the configuration of the present embodiment when the life (replacement cycle) of the lubricant application brush 112 (lubricant applicator) is shorter than the life (replacement cycle) of the paper-dust removing brush 113 (cleaner). In this case, it is possible to improve the ease of replacement of the lubricant application brush 112 frequently replaced, and to regulate the position of the paper-dust removing brush 113 less frequently replaced with a simple configuration.

Figure 16:
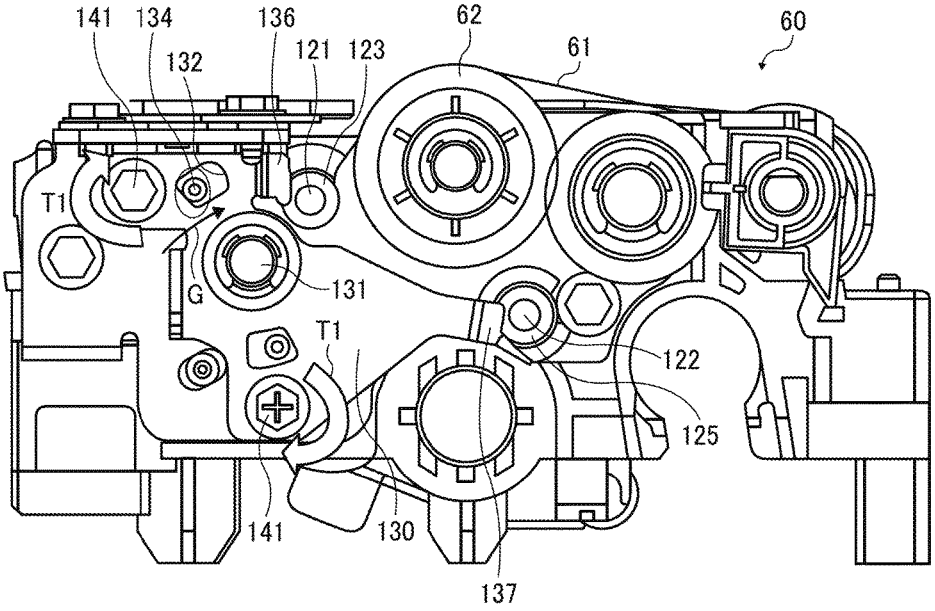
FIG. 16 is a schematic view illustrating a relation between a direction of movement of the regulating member and a direction of fastening a bolt.

In the present embodiment, as illustrated in FIG. 16, as the bolts 141 are rotated clockwise, also the regulating member 130 moves in the clockwise direction. Accordingly, when the bolt 141 is fastened, the regulating member 130 does not move to a direction opposite to the regulating position, and the regulating member 130 can more reliably be held in the regulating position. That is, since the regulating member 130 rotates in the same direction G as a direction T1 of rotation of the bolt 141 by the fastening torque of the bolt 141, the regulating member 130 is positioned on the frame 68 at the position where the regulating member 130 has rotated, thereby preventing defective assembly of the regulating member 130. In the present embodiment, the direction G in which the regulating member 130 moves due to the fastening torque of the bolt 141 and the direction in which the regulating member 130 is positioned by the boss 134 and the slot 132 of the frame 68 are the same.

In the present embodiment, since the regulating member 130 is urged by the arm spring 66 in the direction in which the regulating member 130 is displaced from the releasing position to the regulating position, the lubricant application brush 112 (lubricant applicator) and the paper-dust removing brush 113 (cleaner) can be regulated more reliably.

In the present embodiment, as described with reference to FIGS. 5 to 7, by inclining the rotary shaft 63*a* (roller axis) in conjunction with the deviation of the secondary transfer belt 61 in the axial direction (for example, the right direction in FIG. 5), a force for returning in the reverse direction (for example, the left direction) acts on the secondary transfer belt 61. Therefore, it is possible to eliminate belt deviation with such a simple configuration. Further, the secondary transfer belt 61 can be stably run. Further, the arm spring 66 serving as the urging member urges the end portion of the rotary shaft 63*a* displaced in a predetermined direction (i.e., downward) in conjunction with the belt deviation to be displaced in the opposite to the predetermined direction (i.e., upward). That is, the rotary shaft 63*a* which is inclined in conjunction with the deviation of the secondary transfer belt 61 is urged so as to return to the original position. Accordingly, the displaced shaft inclining member 72 can be returned to original position thereof. After the deviation of the secondary transfer belt 61 has been eliminated, if the secondary transfer belt 61 moves to one side again, the shaft inclining member 72 is displaced again in conjunction with the deviation of the secondary transfer belt 61. With this configuration, it is possible to eliminate the belt deviation again.

Therefore, the arm spring 66 urges the rotary shaft 63*a* to be displaced in the predetermined direction in conjunction with the belt deviation to be displaced in the opposite direction. In addition, the arm spring 66 urges the regulating member 130 in the direction of displacement from the releasing position to the regulating position. Therefore, the above effect can be obtained with a simple and compact configuration.

Figure 17:
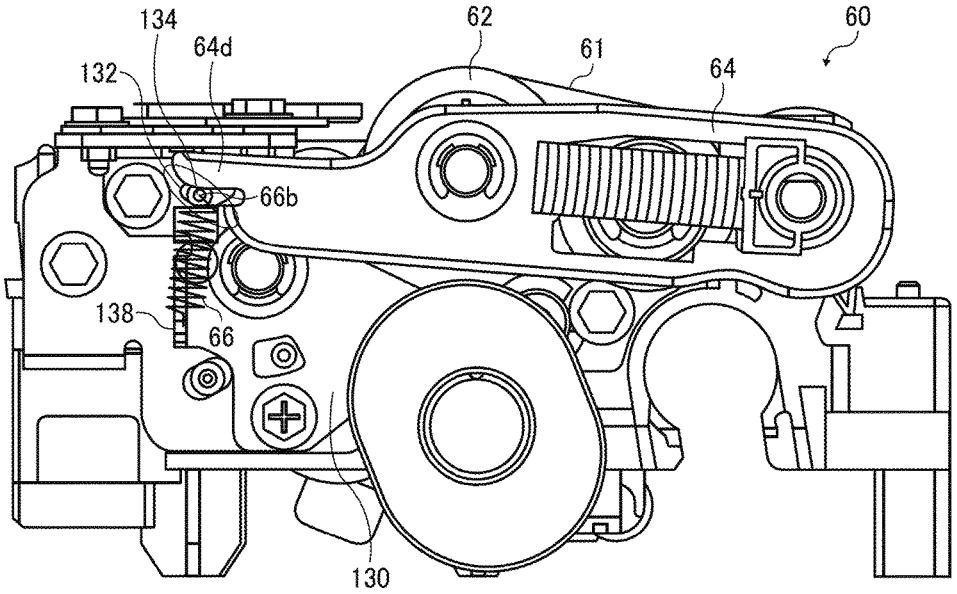
FIG. 17 is a schematic view illustrating a relation between a direction of movement of the regulating member by an urging member and a direction of positioning of the regulating member.

In the present embodiment, as illustrated in FIG. 17, the direction in which the regulating member 130 is positioned on the frame 68 and the direction in which the regulating member 130 is urged by the arm spring 66 are the same. As the arm spring 66 is attached to the shaft support arm 64 and the regulating member 130, the regulating member 130 moves in the direction of positioning, which is the direction to take the regulating position, by the spring force and is positioned on the frame 68, thereby preventing the assembling failure of the regulating member 130.

The other end 66*b* of the arm spring 66 is attached to the shaft support arm 64, and one end 66*a* of the arm spring 66 is attached to the regulating member 130. Therefore, with the simple structure in which the end portions of the arm spring 66 are attached to the rotary shaft support arm 64 and the regulating member 130, the ease of replacement of the contact member such as the lubricant application brush 112 and the like in contact with the secondary transfer belt 61 is improved. The movement of the lubricant application brush 112 can be regulated more reliably and the displacement from the releasing position of the regulating member 130 to the regulating position can be reliably performed.

Figure 18A:
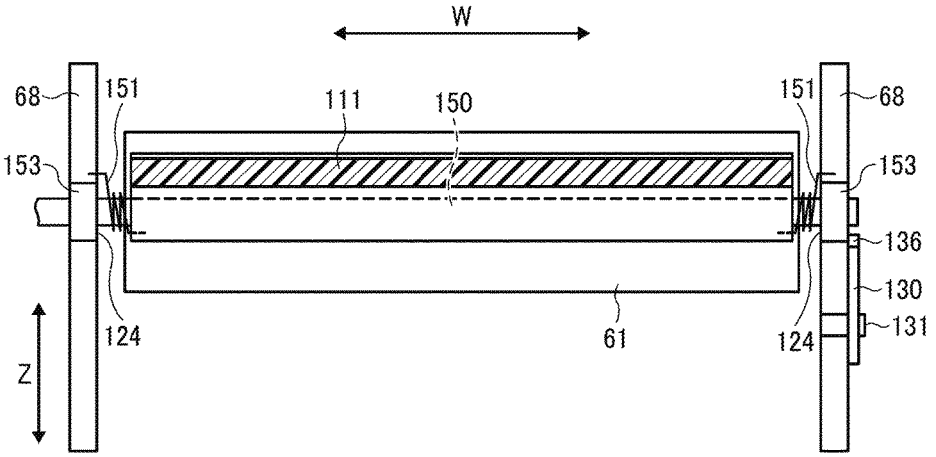
FIGS. 18A and 18B are schematic views of a secondary transfer device according to a modification.
Figure 18B:
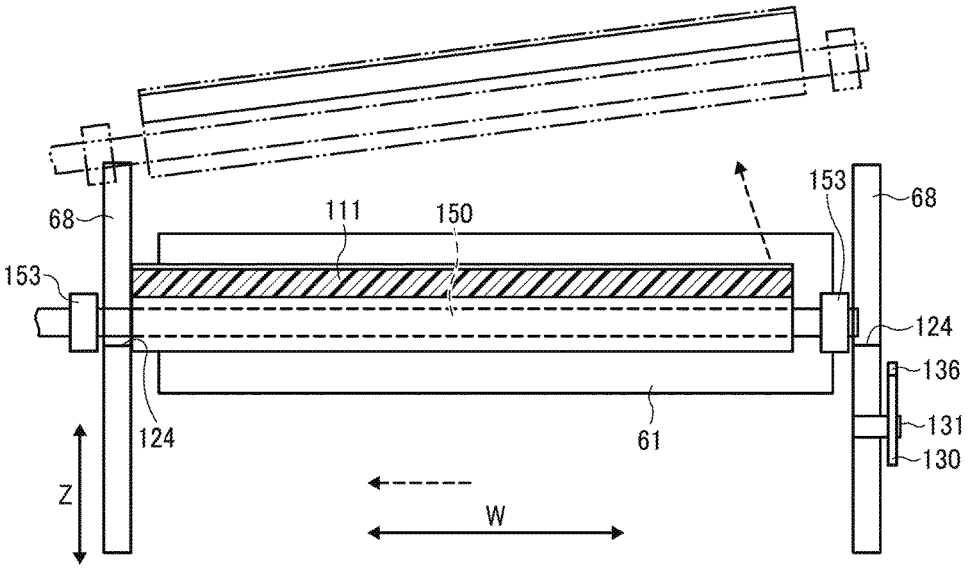

In the above-described embodiment, the lubricant application brush 112, which is the contact member with the secondary transfer belt 61, is exemplified as a member whose movement in the axial direction W is regulated by the regulating member 130, but the member to be regulated is not limited to the lubricant application brush 112. For example of modification, as illustrated in FIGS. 18A and 18B, the cleaning blade 111 is hinged to the frames 68 by the support shaft 150, and urged toward the secondary transfer belt 61 by torsion coil springs 151 to be in pressure contact therewith. In such a case, a support shaft 150 is generally positioned in the axial direction W by attaching an E-ring or the like on an outer periphery of the support shaft 150. However, in place of the E-ring, the end portions on both sides of the support shaft 150 are rotatably supported by ball bearings 153 so that, when the regulating member 130 takes the regulating position, the regulating member 130 overlaps with the one ball bearing 153. Therefore, it is possible to improve the workability in replacement while positioning the cleaning blade 111 in the axial direction W. Alternatively, for example, a contact member is an electrostatic brush to be regulated in the axial direction W by the regulating member 130.

An object to be regulated by the regulating member 130 to improve the positioning stability in the axial direction W and facilitate replacement is not limited to a member contacting or pressed against the secondary transfer belt 61. Alternatively, for example, the object is a member contacting or pressed against the intermediate transfer belt 51.

In the above-described embodiment and the modification, the example in which the regulating member 130 is rotationally moved from the regulating position to the releasing position is described. Alternatively, the regulating member 130 can be configured to slide linearly.

The above-described embodiment and the modification concern the example in which the ball bearing 123 is used as a bearing. Alternatively, for example, roller bearings or plain bearings can be used as bearings.

The above-described embodiments are illustrative and do not limit the present disclosure. Thus, numerous additional modifications and variations are possible in light of the above teachings unless limited in the above description.

The effects obtained by the above-described embodiments are examples. The effects obtained by other embodiments are not limited to the above-described effects.

What is claimed is:

1. A belt device comprising:

an endless belt;

a contact member to contact the belt;

a support shaft to support the contact member and rotate together with the contact member; and a regulating member to regulate movement of the contact member in an axial direction of the support shaft, the regulating member to move between a regulating position to regulate movement of the support shaft and a releasing position to allow movement of the support shaft.

2. The belt device according to claim 1, further comprising:

a bearing attached to the support shaft; and a frame to support the bearing, wherein the regulating member in the regulating position separates from the support shaft and contacts the bearing.

3. The belt device according to claim 2, wherein the bearing includes an outer ring, an inner ring, and a rolling element disposed between the outer ring and the inner ring, and wherein the regulating member in the regulating position separates from the inner ring and contacts the outer ring.

4. The belt device according to claim 2, further comprising a fastening member to fasten the regulating member to the frame in the regulating position, wherein a direction in which the regulating member moves by fastening torque of the fastening member is same as a direction in which the regulating member moves from the regulating position to the releasing position.

5. The belt device according to claim 2, wherein the regulating member in the regulating position contacts the bearing from outside to position the contact member in the axial direction.

6. The belt device according to claim 1, wherein the contact member is a lubricant applicator to apply lubricant to the belt.

7. The belt device according to claim 1, further comprising a cleaner to clean a surface of the belt, wherein the regulating member in each of the releasing position and the regulating position regulates movement of a support shaft of the cleaner.

8. The belt device according to claim 1, further comprising an urging member to urge the regulating member in a direction in which the regulating member moves from the releasing position to the regulating position.

9. The belt device according to claim 8, further comprising:

a roller to rotate together with a rotary shaft of the roller, the roller to support the belt; and a shaft inclining member to move in conjunction with deviation of the belt in the axial direction to incline the rotary shaft in a predetermined direction, wherein the urging member urges the rotary shaft to incline the rotary shaft in a direction opposite to the predetermined direction.

10. The belt device according to claim 9, further comprising a shaft support arm to support and displace the rotary shaft in both the predetermined direction and the direction opposite to the predetermined direction, wherein one end of the urging member is attached to the shaft support arm and an end of the urging member other than the one end is attached to the regulating member.

11. The belt device according to claim 9, further comprising: a belt deviation detector to move in the axial direction in conjunction with deviation of the belt and contact an end face of the belt, wherein the shaft inclining member contacts the belt deviation detector and moves in the axial direction in conjunction with the deviation of the belt.

12. The belt device according to claim 1, wherein the belt is a conveyance belt to convey a recording medium.

13. An image forming apparatus comprising:

an image bearer to bear an image on a surface of the image bearer; and the belt device according to claim 1 to transfer the image from the image bearer to a recording medium.

14. The image forming apparatus according to claim 13, wherein the image bearer is an intermediate transferor onto which a plurality of images of different colors are superimposed and transferred.

* * * * *